US009506187B2

(12) United States Patent
Minko et al.

(10) Patent No.: US 9,506,187 B2
(45) Date of Patent: Nov. 29, 2016

(54) TEXTILE DYEING USING NANOCELLULOSIC FIBERS

(71) Applicants: University of Georgia Research Foundation, Inc., Athens, GA (US); Clemson University, Clemson, SC (US)

(72) Inventors: Sergiy Minko, Athens, GA (US); Suraj Sharma, Athens, GA (US); Ian Hardin, Athens, GA (US); Igor Luzinov, Clemson, SC (US); Sandy Wu Daubenmire, Athens, GA (US); Andrey Zakharchenko, Athens, GA (US); Raha Saremi, Athens, GA (US); Yun Sang Kim, Athens, GA (US)

(73) Assignees: University of Georgia Research Foundation, Inc., Athens, GA (US); Clemson University Research Foundation, Inc., Clemson, SC (US)

( * ) Notice: Subject to any disclaimer, the term of this patent is extended or adjusted under 35 U.S.C. 154(b) by 0 days.

(21) Appl. No.: 14/796,195

(22) Filed: Jul. 10, 2015

(65) Prior Publication Data

US 2016/0010275 A1 Jan. 14, 2016

Related U.S. Application Data

(60) Provisional application No. 62/023,573, filed on Jul. 11, 2014.

(51) Int. Cl.

| | |
|---|---|
| ***D06P 5/00*** | (2006.01) |
| ***D06P 1/00*** | (2006.01) |
| ***D06P 1/50*** | (2006.01) |

(52) U.S. Cl.
CPC ..... *D06P 1/0016* (2013.01); *D06P 1/0052* (2013.01); *D06P 1/50* (2013.01)

(58) Field of Classification Search
CPC ..... D06P 1/0016; D06P 1/50; D06P 1/0052
See application file for complete search history.

(56) References Cited

U.S. PATENT DOCUMENTS

2013/0273350 A1* 10/2013 Lee ..... D06M 15/05 428/326

* cited by examiner

*Primary Examiner* — Eisa Elhilo
(74) *Attorney, Agent, or Firm* — Thomas | Horstemeyer, LLP

(57) ABSTRACT

Disclosed are various embodiments for dyeing a material using a dyed nanocellulose dispersion, thereby reducing or eliminating the need for water in dyeing materials, such as fabrics and textiles. A dyed nanocellulose dispersion or gel may be prepared from wood pulp fibers using a homogenizer and a dye, wherein the dyed nanocellulose dispersion comprises nanosized cellulose fibrils. The dyed nanocellulose gel may comprise an approximate concentration of 0.5% to 6%. The dyed nanocellulose dispersion may be applied to a material, such as a fabric or textile material. The fabric or textile material can be dried resulting in a dyed material.

26 Claims, 13 Drawing Sheets
(10 of 13 Drawing Sheet(s) Filed in Color)

Reactive Red 120 Dye Molecule polyethylenimine (PEI)

poly(glycidyl methacrylate) (PGMA)

poly (oligo(ethylene glycol) methacrylate) (POEGMA)

TEXTILE DYEING USING NANOCELLULOSIC FIBERS

CROSS-REFERENCE TO RELATED APPLICATION

The present disclosure claims the benefit of and priority to U.S. Provisional Patent Application No. 62/023,573, filed on Jul. 11, 2014, and entitled "TEXTILE DYEING TECHNIQUES USING NANOCELLULOSIC FIBERS," the contents of which are hereby incorporated by reference in its entirety herein.

BACKGROUND

Nanocellulose is a material composed of nanosized cellulose fibrils with a relatively high length to width ratio. Traditionally, to create nanocellulose, nanocellulose fibrils are isolated from wood-based fibers using high-pressure homogenizers that are employed to delaminate the cell walls of fibers and free the nanosized fibrils.

A commonly employed fabric dyeing technology is based on a wet process where textile materials are brought into contact with solutions or suspensions of chromophore chemicals and surfactants, salts and other additives. As may be appreciated, these technologies use copious amounts of water and generate large volumes of waste water.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1A:
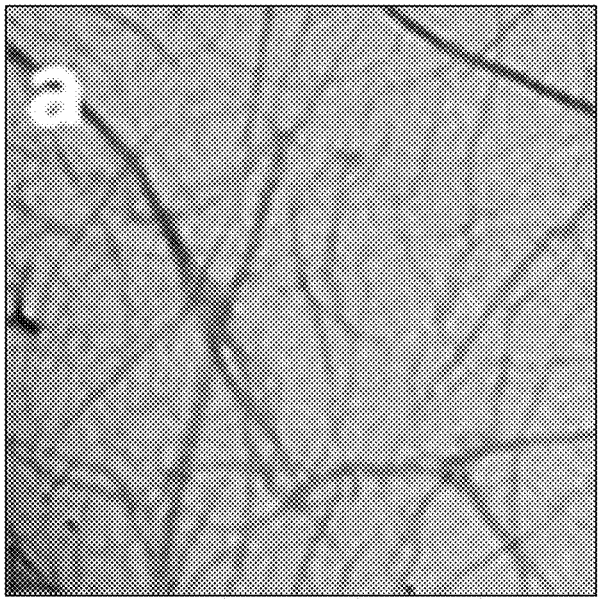
FIGS. 1A-1E show representative scanning electron microscope (SEM) images of nanocellulose.

The present disclosure relates to dyeing materials, such as textiles, using nanocellulosic fibers. More specifically, a process is described wherein a fabric is dyed using nanocellulose, thereby reducing or eliminating the need for water in dyeing fabrics and yarns, such as cotton, polyester, and/or other materials. As will be described herein, a nanocellulose solution may be employed to permanently bind dye or other materials to textile surfaces as a uniform thin film. According to various embodiments, a nanocellulose solution or gel may be employed to fixate dye, antimicrobial, flame retardant, stain and soil resistant, hydrophilic, and/or other molecules to polyester, acrylic, polypropylene, nylon, cotton, and other types of fabrics. The dyeing of materials may be conducted during or after a nanocellulose-dye processing step, as will be described herein.

A commonly employed fabric dyeing technology is based on a wet process where textile materials are brought into contact with solutions or suspensions of chromophore chemicals and surfactants, salts, and other additives. As may be appreciated, these technologies use copious amounts of water and generate large volumes of waste water. It is difficult to create new classes of dyestuffs that address these problems because of costs of ecotoxicological testing.

Current practices of dyeing textiles are environmentally unfriendly, though much effort has been exerted to reduce consumption of water and energy. Moreover, dyeing effluent is a major contributor to the impact of textile manufacturing on the environment. Because of this, there are continuing efforts to develop cleaner and more cost-effective technologies. Such measures include foam dyeing, reactive cold-pad dyeing, dyeing using nanosized pigment particles, electrochemical coloration, supercritical fluid $CO_2$ dyeing, and coloration using plasma, ultrasonic, and microwave technologies.

The major problems associated with these technologies are specific to each selected method. However, the most common problems are poor scalability, ecological- and health-related problems, and high costs. The present disclosure relates to developing coloration using nanotechnology that can be applied to continuous and scalable pad-dyeing and rotary screen printing using highly specific area nanocellulose particles that accommodate and bind chromophores to fiber surfaces. Although some embodiments described herein employ colored or dyed nanocellulose in pad-dyeing and rotary screen printing, other industrial methods such as package dyeing may also be employed. Additionally, in some embodiments, a non-aqueous and/or no-solvent dyeing process may be employed using supercritical carbon dioxide (SC—$CO_2$) solvents and media.

As will become apparent, an amount of energy required to dye and dry textiles using nanocellulose is a fraction of that required for conventional dyeing. Due to the greatly increased fixation of dyes, the environmental impact and cleanup of the dyeing process is greatly reduced. Further, the sustainability quotient of the embodiments described herein is very high compared to conventional dyeing processes and provides conditions required for broad applications. In some embodiments, commercially available dyes and nanocellulose may be employed. In other embodiments, nanocellulose may be produced from wood pulp fiber, traditionally available in bulk, using mechanical milling and homogenization processes.

According to various embodiments, the use of nanocellulose may act as both a carrier for dye molecules (or other molecules) and as a binding agent (also referred to as a gluing agent) that adheres to fibers in textile materials, such as yarns and fabrics. Nanocellulose may be obtained from widely available cellulose in wood and in cellulosic waste products generated on farms and in industry. In essence, the nanocellulose is a cellulose fibril with widths in the nanometer range. Nanocellulose has a very high specific surface area with concomitant extremely large concentrations of OH functional groups available for chemical reaction with and hydrogen bonding to dye molecules and to the fibers in the yarns and fabrics.

The potential binding forces of dyes to fibers through nanocellulose are much higher than in conventional dyeing. Because of the high binding forces, reduced amounts of dyes can be used and dye remaining in the waste water can almost be eliminated. As may be appreciated, this provides great environmental advantages. The embodiments described herein may be applied in chemical finishes to fabrics at a much greater efficiency level. These include, for example, flame retardant, antimicrobial, and stain and soil resistant finishes, as well as attaching hydrophilic finishes to polyester and other types of textile materials.

Nanocellulose provides a strong interaction with various materials. In various embodiments, nanocellulose prepared from wood pulp fibers may be knife milled and homogenized using a homogenizer. In some embodiments, a GAULIN® homogenizer may be employed to create a nanocellulose gel with a 0.5% to 6% concentration.

Figure 1B:
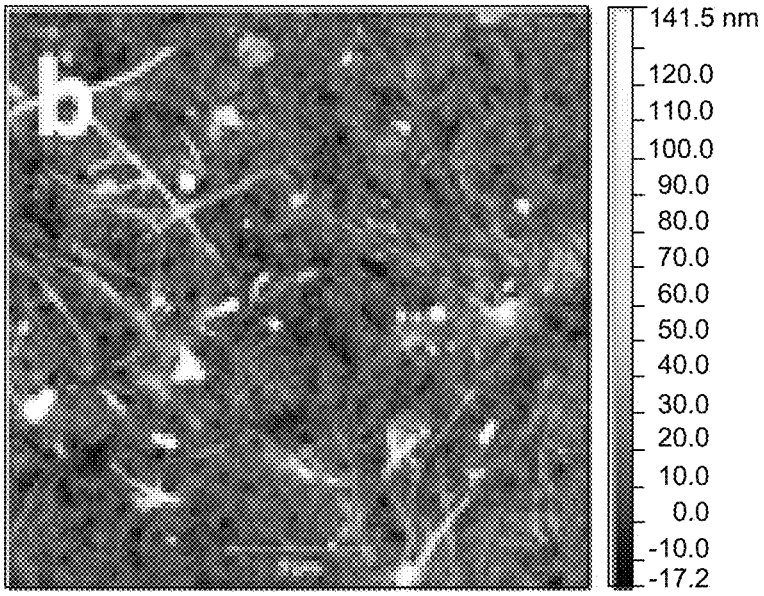

A representative scanning electronic microscope (SEM) image of nanocellulose is shown in FIG. 1A. The fibrils of nanocellulose are 20-50 nm in diameter and several micrometers long. With such a small diameter, nanocellulose fibers have a very large specific surface area—hundreds of square meters per gram. Due to the high specific area, nanocellulose can bind large amounts of dye molecules or other finishing materials to various textiles and materials. Because of their flexibility and the high concentration of surface functional groups, nanocellulose fibrils strongly interact with various substrates. FIG. 1B depicts single nanocellulose fibrils deposited on the surface of a flat cellulose film. The samples can be dried at different temperatures ranging from room temperature (e.g., 20° C. to 26° C.) to 150° C. In some embodiments, the samples can be dried at approximate temperatures of 20° C., 50° C., 60° C., 100° C., 120° C., or 150° C. The samples can then be rinsed or soaked in a rinsing solution, such as deionized (DI) water. In some embodiments, the samples can be rinsed or soaked in the DI water for an approximate period of twelve hours.

Figure 1C:
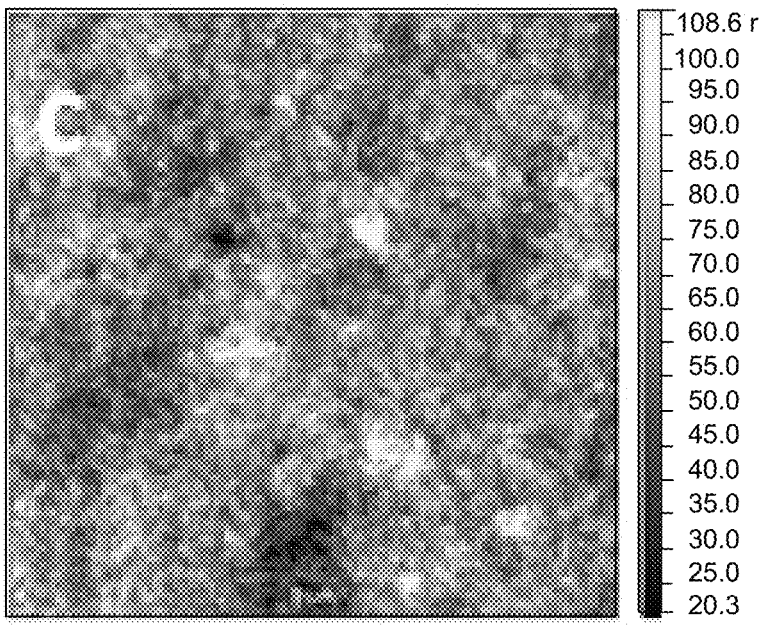
Figure 1D:
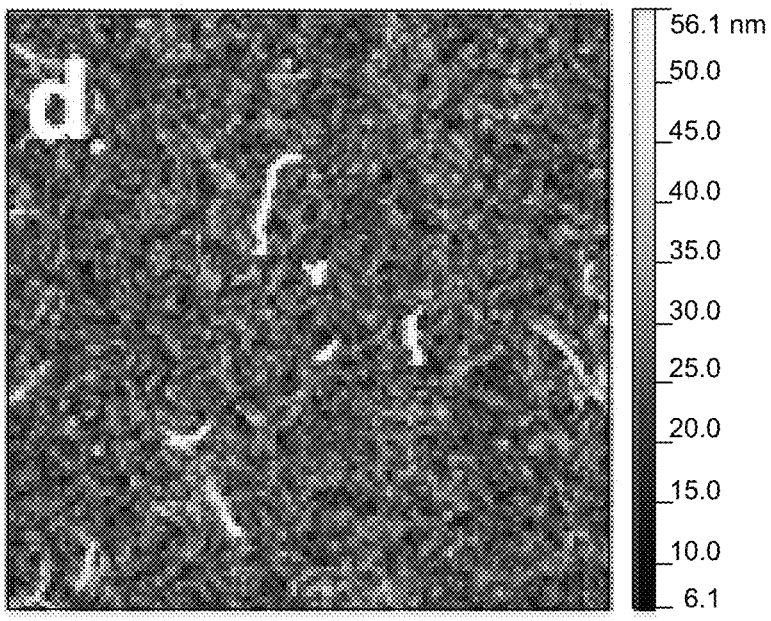
Figure 1E:
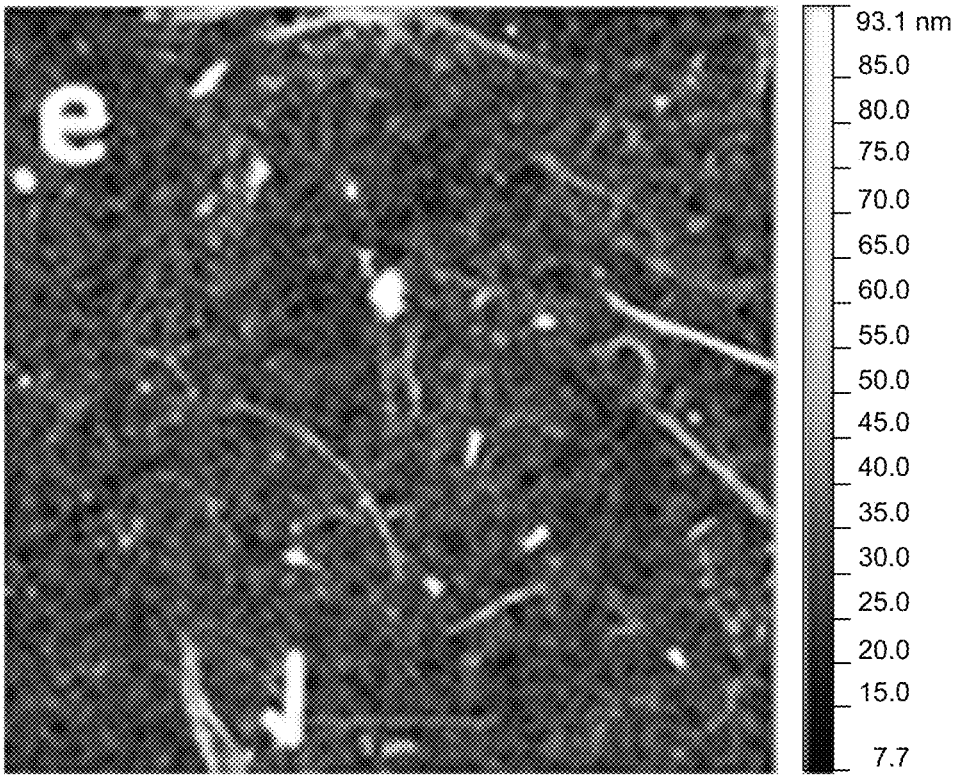

In FIG. 1C, after rinsing or soaking, the adsorbed nanocellulose fibrils can be dried at room temperature (e.g., 20° C. to 26° C.) or other suitable temperature. FIG. 1D shows retainment of nanocellulose fibrils on the samples that are dried at 60° C. FIG. 1E shows retainment of nanocellulose fibrils on the surfaces that are dried at 100° C. As is evident from FIGS. 1A-1E, strong interactions between nanocellulose surfaces and the surface of cellulose film are shown, which may be a model for cotton fabrics. As drying removes absorbed water molecules, drying further establishes hydrogen bonding between cellulose fibrils and the cellulose substrate upon cooling of the material.

According to various embodiments, a certain quantity of nanocellulose solution or gel may be mixed with a dye stock having a predefined dye concentration. In some embodiments, the dye stock includes a cold Reactive Red 120 dye stock solution having a certain dye concentration. The colored or dyed nanocellulose gel may then be padded manually on a material surface, such as a 100% cotton fabric surface. The samples can then be dried at, for example, 100° C. for 90 seconds, followed by conditioning for a predefined period of time (e.g., approximately two hours) and then a rubbing fastness crocking test.

Figure 1F:
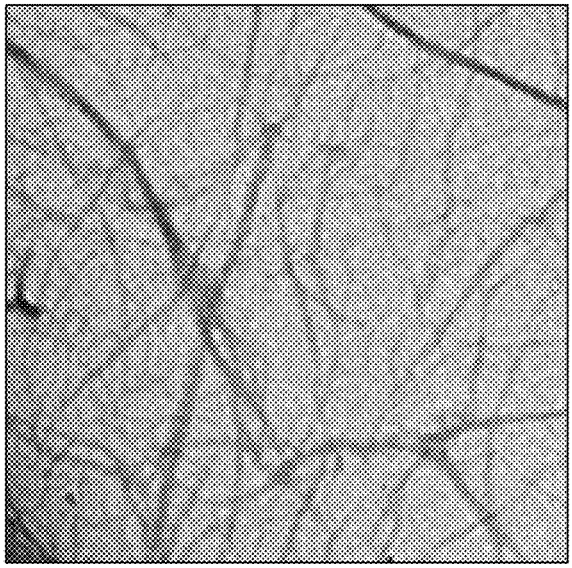
FIG. 1F shows a representative transmission electron microscope (TEM) image of nanofibrillated cellulose.
Figure 1G:
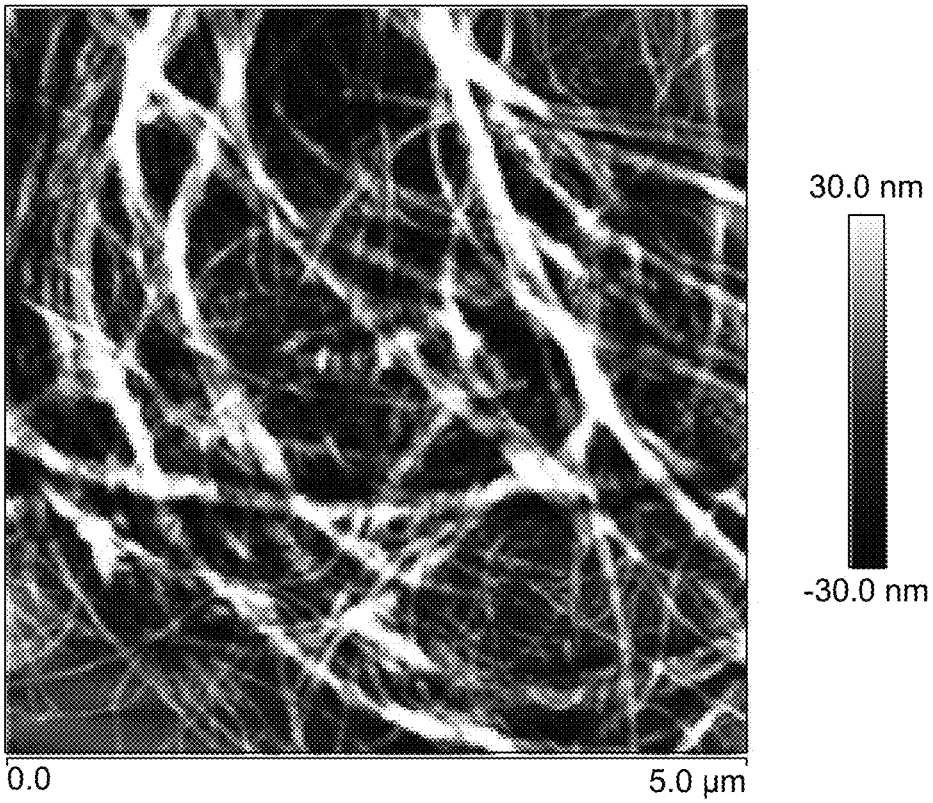
FIG. 1G shows a representative atomic force microscope (AFM) image of nanofibrillated cellulose deposited on a silicon wafer.
Figure 1H:
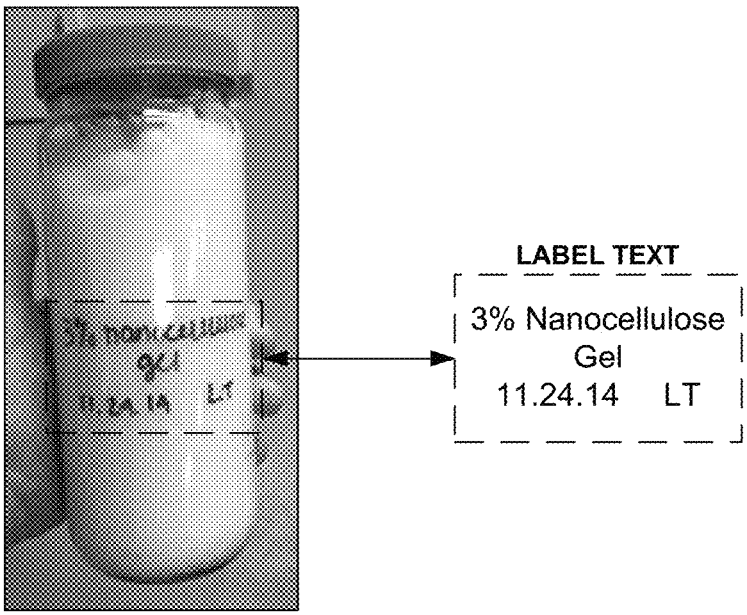
FIG. 1H shows a mass-produced nanofibrillated gel dispersion in water.
Figure 2A:
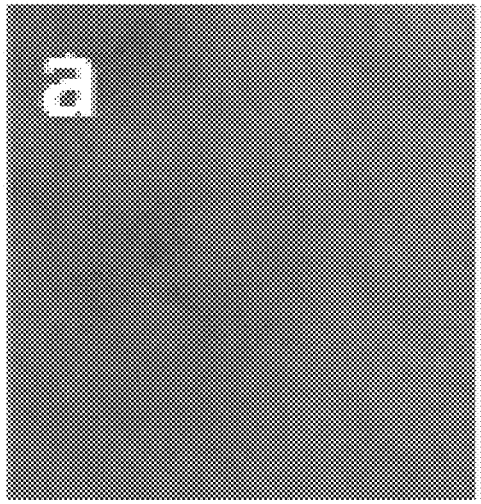
FIG. 2A shows a control material dyed using a dye stock solution in a standard dyeing process without nanocellulose-dye.
Figure 2B:
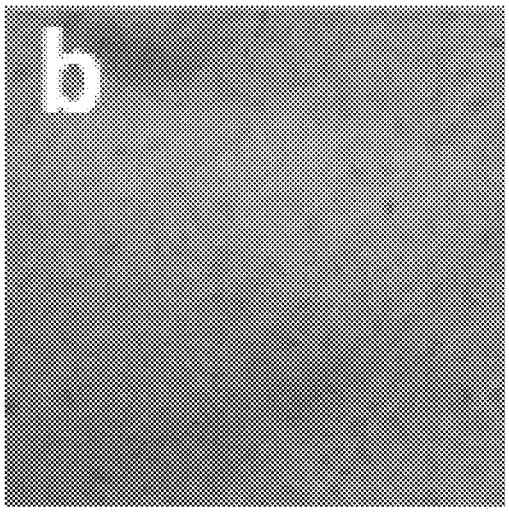
FIG. 2B shows a fabric dyed with nanocellulose-dye prepared as a one milliliter (1 mL) dye stock solution and 10 grams of nanogel according to various embodiments of the present disclosure.
Figure 2C:
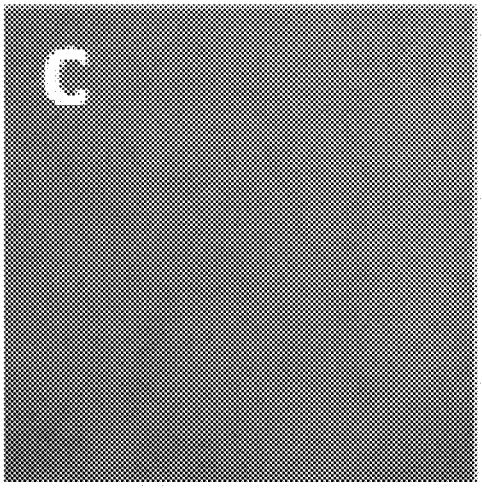
FIG. 2C shows a fabric dyed with nanocellulose-dye prepared as a two milliliter (2 mL) dye stock solution and 10 grams of nanogel according to various embodiments of the present disclosure.
Figure 2D:
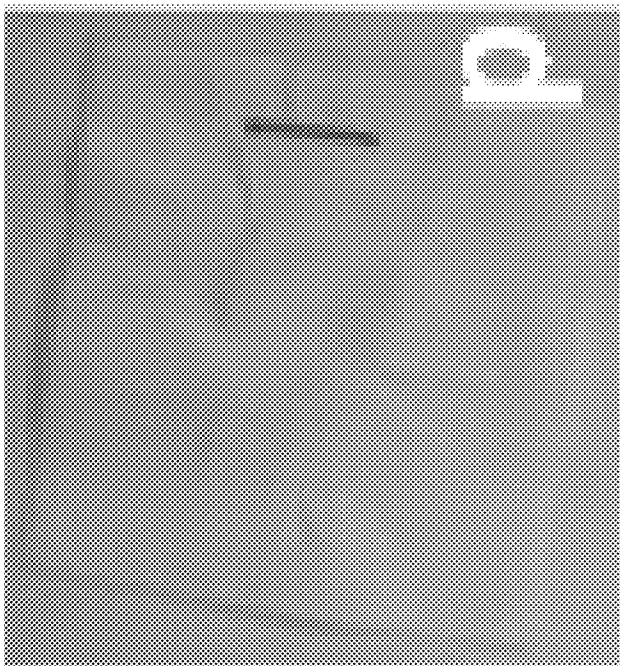
FIGS. 2D-2F show a dry crock square appearance according to various embodiments of the present disclosure.
Figure 2E:
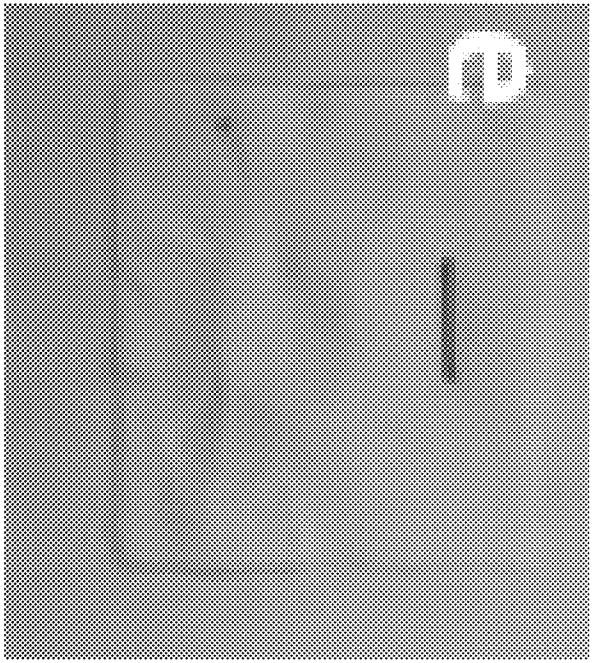
Figure 2F:
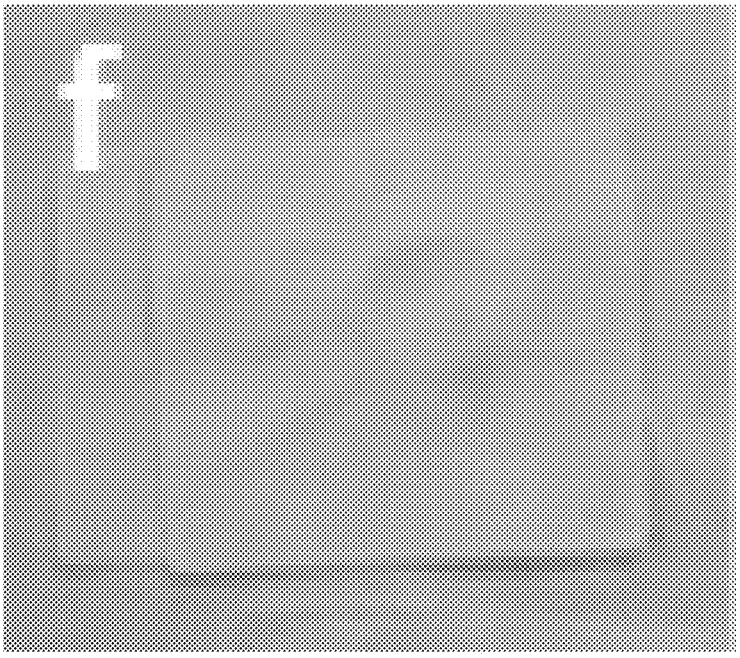
Figure 2G:
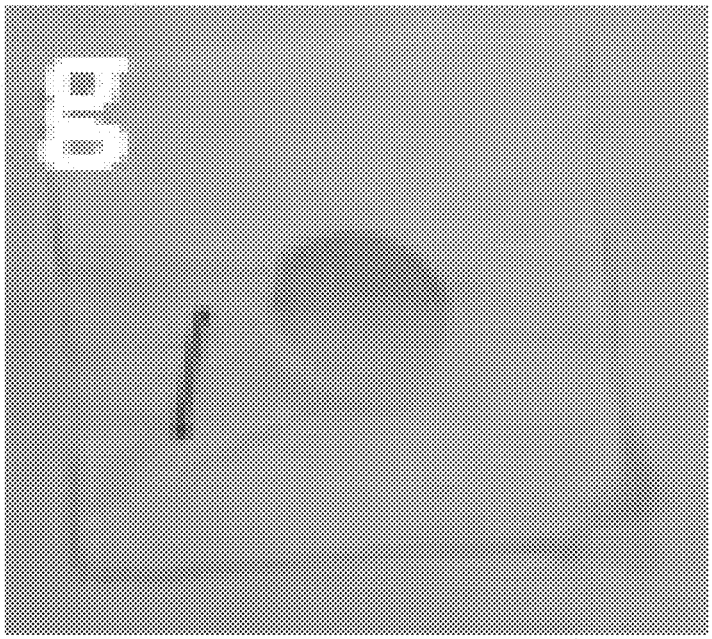
FIGS. 2G-2I show a wet crock square appearance according to various embodiments of the present disclosure.
Figure 2H:
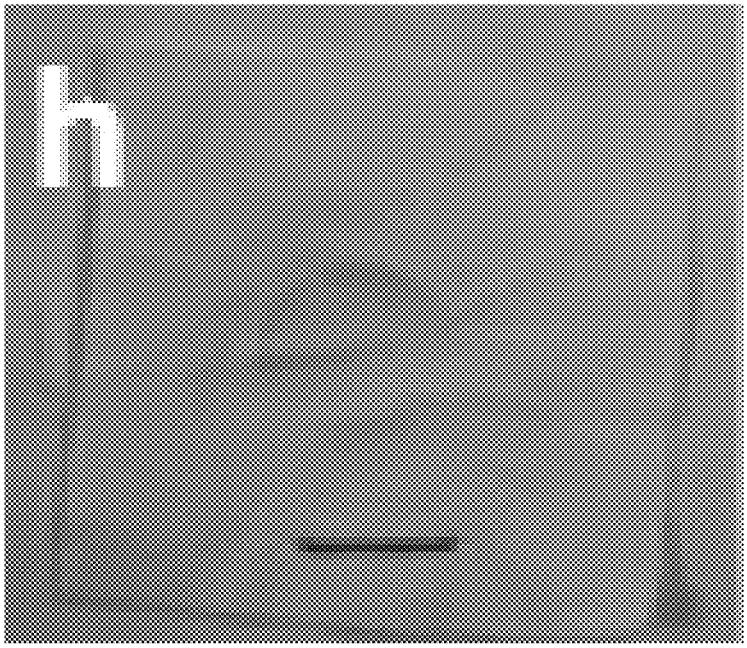
Figure 2I:
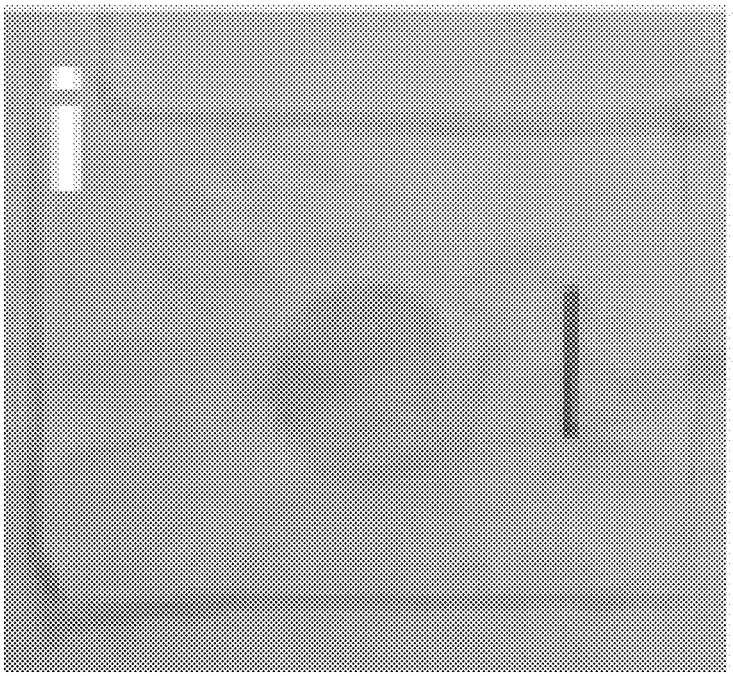

In some embodiments, nanofibrillated cellulose may be produced from wood pulp by high-pressure homogenization. For example, a kraft pulp sheet may be milled to the order of tens of micrometers in width and hundreds of micrometers in length. The resulting milled pulp powder may then be delaminated to nanosize fibrils by a high-pressure homogenizer with multiple passes, whose average width ranges on the order of tens of nanometer and average length on the order of micrometer as shown in FIG. 1F and FIG. 1G. In some embodiments, the high-pressure homogenizer includes an APV-100 manufactured by SPX®. The prepared nanofibrillated cellulose exhibits gel-like appearance as shown in FIG. 1H. The gel remains stable and shows no signs of phase separation or precipitation after several months.

The results of the processes described herein are shown in FIGS. 2A-2I, which include samples of cotton fabrics colored using nanocellulose-dye (ND). The samples show good rubbing fastness and crocking resistance. As shown in FIGS. 2A-2I, the nanocellulose, with the dye included (referred to as dye-functionalized nanocellulose or nanocellulose-dye), remains on the surface of the colored fabrics. Further, FIGS. 2A-2I illustrate effects of reducing water consumption as the colored fabrics were not rinsed with water. To accomplish this, the amount of water in the nanocellulose-dye gel may be adjusted based on the type of material to which the nanocellulose-dye gel is applied. For example, an absorption rate of the nanocellulose-dye gel versus the material may be used to vary an amount of water used to create the nanocellulose-dye. In other words, the water is adjusted to provide appropriate rheological behavior of the slurry. FIGS. 2D-2I illustrate results of a rubbing fastness test that prove greater fastness of nanocellulose-dye versus a control shown in FIG. 2G.

According to various embodiments of the present disclosure, economically and environmentally positive dyeing techniques are described that are superior to their traditional counterparts, as measured by water and energy consumption, product performance, and cost effectiveness. Nanocellulose-based dyeing procedures reduce water and energy consumption while improving the textile product performance.

The embodiments described in the present disclosure may be employed to develop commercially viable, cost-effective, and environmentally friendly nanocellulose based dyeing procedures. As described, nanocellulose based dyeing techniques significantly reduce the dye-liquor ratio (meaning less water consumption), dye auxiliaries, and energy consumption (less drying required). These, in turn, reduce the dye discharged in the effluents. The very high specific surface of nanocellulose particles covered with functional hydroxyl groups are substantive for dye molecules and provide maximum adhesion of nanocellulose-dye to the fibers and yarns.

Nanocellulose gels may be used in conjunction with water-soluble and/or disperse dyes to prepare laboratory-scale batch dyeing of natural and manufactured fiber textiles. The dye classes traditionally used for cellulose based textiles, such as directs and reactives, may be applied to bind with nanocellulose. Preference may be given to procedures with no surfactant and no, or very limited amounts, of additional chemicals. The ratio of nanocellulose to dye may be determined to optimize the binding of the dyes. The process of dye binding to the nanocellulose may be measured kinetically by monitoring the concentrations of unbound dyes with UV-Vis spectroscopy and fluorescent spectroscopy (e.g., for fluorescent dyes). Residual chemicals in the liquor may be analyzed using mass-spectrometry. As soon as conditions for the synthesis of nanocellulose-dye are developed through selections of appropriate dyes, concentrations and temperatures, the fabrication of nanocellulose and its dyeing to generate nanocellulose-dye may be combined in a single step. The synthesis of nanocellulose, nanocellulose-dye, and optimization of dyeing liquor compositions may be conducted.

Dyeing properties, such as color yields (K/S), color differences (ΔE), exhaustion (E), fixation (F) and reactivity (R) at different dye concentrations (range of shades) may be measured to confirm the viability of using nanocellulose. Fabric properties tests developed by the American Association of Textile Chemists and Colorists (AATCC), such as wet and dry crocking and water and perspiration fastness, can be critical to evaluating the dyeing performance. Controls may be produced using traditional batch dyeing processes. In order to broaden the applicability of the nanocellulose based dyeing on various textile substrates, nanostructural analyses and nanocellulose modifications may be undertaken to understand the adhesion and dyeing mechanisms. Nanocellulose-dyes may be applied to cotton yarns and fabrics.

Two non-limiting examples of methods for applying nanocellulose to fabric are described. First, nanocellulose may be applied to a material, such as a textile material, using pad dyeing. In pad dyeing, nanocellulose-dye is dispersed in water and applied to the fabric by means of a padder. The fabric is first saturated in the pad bath. Then, the excess of liquor is removed from the material (e.g., squeezed off) and/or dried. Second, nanocellulose may be applied to a material, such as a textile material, using rotary screen printing. In rotary screen printing, a perforated cylindrical screen may be employed to apply nanocellulose-dye dispersed in water onto the material. Then, the nanocellulose-dye liquor may be forced from the interior of the perforated cylindrical screen onto the material. As discussed herein, the material may comprise, for example, textile material comprising polyester fibers, acrylic fibers, polypropylene fibers, cotton fibers, nylon fibers, a combination thereof, or other suitable fibers.

For both the pad and printing processes described above, the optimal concentration for nanocellulose-dye in the liquor and the necessary temperature profile for a drying oven to reach uniform and permanent dyeing may be predetermined. For example, rheometrical measurements may be employed to identify the viscosity of the nanocellulose-dye liquors that offer the best results. The viscosity values may be used to provide guidance for the subsequent dyeing.

Further, in some embodiments, nanocellulose-dyes may be dispersed in water for package dyeing, which may be used to dye yarn or fabric. Dyeing may be conducted via forced circulation of nanocellulose-dye liquor through packages of cotton yarn and fabric. The dynamics of nanocellulose-dye transfer, sorption, and diffusion may be determined in a dyeing cycle for different nanocellulose-dye liquor concentrations. The evenness of the nanocellulose-dye-based dyeing may be monitored. According to various embodiments, the nanocellulose-dye based liquor may be reused. Namely, after the package dyeing process is complete, the concentration of the dye left in the liquor may be replenished by adding a nanocellulose-dye in a concentrated dispersion for future use. For each replenished cycle, the dynamics of nanocellulose-dye transfer, sorption, and diffusion may be determined and compared with the initial, "fresh" nanocellulose-dye dyeing process.

In various embodiments, nanocellulose-dye-based dyeing, using supercritical carbon dioxide (SC—$CO_2$) fluid media, may be employed in various embodiments. In this non-limiting example, the dry nanocellulose-dye may be placed with fabric, yarn, or other material (e.g., in the form of skeins) into a supercritical $CO_2$ reactor. $CO_2$ gas may be supplied from the gas cylinder, cooled, changed to liquid, and pumped by the $CO_2$ liquid pump into the reactor after preheating. After the process is completed in $CO_2$, the reactor may be depressurized and fabric, yarn, or other material may be removed. The material may be used for measurement of dyeing evenness and permanency. The level of dyeing and nanocellulose-dye utilization may be measured as a function of time.

The dyeing of cotton fibers can be difficult due to the fact that conventional water-soluble polar dyes, which are used for cotton fibers, are hard to dissolve in a hydrophobic supercritical carbon dioxide fluid. Therefore, the solubility of nanocellulose-dye in supercritical $CO_2$ may be measured. To this end, in various embodiments, the surface of nanocellulose-dye may be modified using functional groups with short hydrophobic molecules using synthetic methods.

Water reduction is critical in the dyeing industry to reduce the cost of wastewater treatment and coloring issues. Every gram of dyeing consumes 5,000 L of water per ton of cotton textile. The embodiments described herein are expected to reduce more than 80% of water consumption and significantly reduce the wastewater treatment cost. Further, the embodiments described herein may extend to various kinds of fibers and fabrics, including other major natural and synthetic polymers. In various embodiments, a dry-dyeing process using dry powder of nanocellulose-dye may be employed to simplify dyeing technology and further minimize water and energy use.

Figure 3:
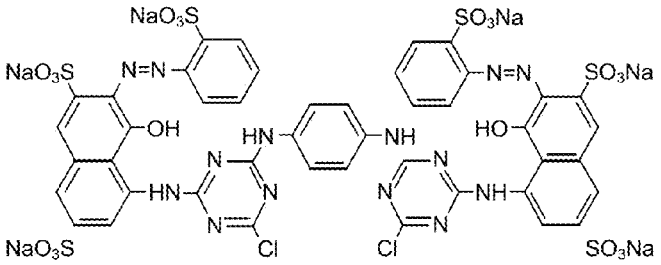
FIG. 3 shows the chemical structure of Reactive Red 120 dye molecule.
Figure 4:
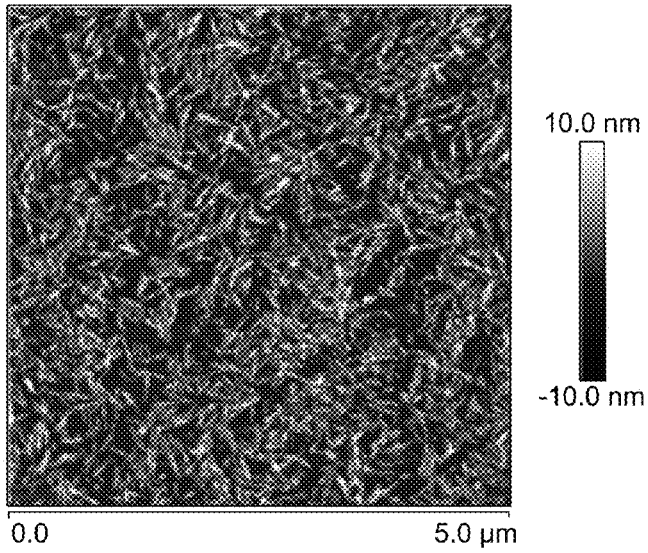
FIG. 4 shows a representative atomic force microscope (AFM) image of cellulose nanocrystals (CNC) deposited on a silicon wafer.

FIG. 3 shows the chemical structure of the Reactive Red 120 dye molecule. In some embodiments, a commercially available Reactive Red 120 is selected because of its facile covalent bond formation on cellulosic fibers. For the development of a nanocellulose-dye solution or gel, nanofibrillated cellulose (NFC) as well as cellulose nanocrystals (CNC) (e.g., CNC, The Process Development Center, University of Maine) may be utilized. The major differences of NFC and CNC include the width of nanocellulose fibrils which is several tens of nanometers for NFC and around 10 nm for CNC, as shown in FIG. 4, and the higher crystallinity of CNC compared to NFC. As may be appreciated, the dimension and crystallinity may influence not only the incorporation of dye molecules in a nanocellulose matrix, but also the adhesion between nanocellulose gel-dye and textiles.

Figure 5:
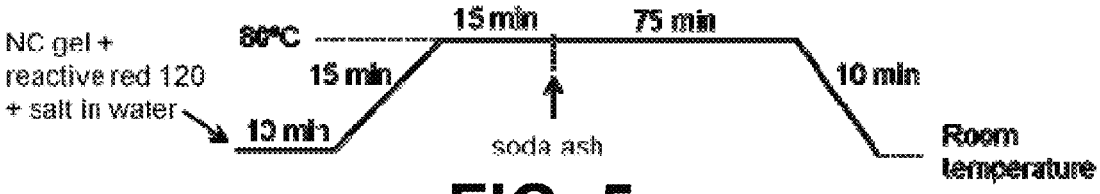
FIG. 5 shows a sequence illustrating one example for a nanocellulose gel dyeing process according to various embodiments of the present disclosure.

With respect to FIG. 5, a sequence is shown illustrating one example for a nanocellulose gel dyeing process according to various embodiments of the present disclosure. In various embodiments, the incorporation of dye in a nanocellulose matrix is performed by directly mixing dye molecules, nanocellulose gel, salt, and soda ash in accordance with the sequence illustrated in FIG. 5. As nanocellulose gel is in a swollen state in water, the addition of water is not necessary. The liquor ratio (i.e., the weight ratio of water to dry cellulose) is determined according to the concentration of nanocellulose gel in water. In various embodiments, an optimal liquor ratio may be 50:1.

After a reaction, the dyed nanocellulose gel is collected by centrifugation at approximately 8500 revolutions per minute or other suitable centrifuge speed. The resulting supernatant is used to determine dye exhaustion with predetermined dilution ratio by using ultraviolet-visible spectroscopy (UV-Vis) with the UV-2401 PC manufactured by SHIMADZU®. A soaping treatment may then be applied. In some embodiments, the soaping treatment can be performed at 95° C. for 1 hour or other suitable temperatures and times. Based on an International Organization for Standardization (ISO) 105-C06 textile test for color fastness, the color strength of dyed nanocellulose gel is measured by a color spectrophotometer, such as the Macbeth Color-Eye 7000A, at 510 nm.

As may be appreciated, dye exhaustion is a measure of how many dye molecules are consumed in a dyeing process, which takes the ratio of maximum absorbance associated with dye molecule employed before and after the dyeing process. Dye exhaustion may be measured via:

$$E = \frac{A_o - A_d}{A_o}, \quad \text{(eq. 1)}$$

where E represents dye exhaustion, $A_o$ represents initial absorbance, and $A_d$ represents absorbance after dyeing.

In various embodiments, the nanocellulose-dye may be applied on both sides of a fabric (e.g., a cotton fabric) or other textile material by using a squeegee. An initial drying period may follow, for example, at 60° C. for 20 minutes. Subsequent curing may be performed at a suitable temperature. In some embodiments, the temperature is approximately 20° C. to 150° C. or higher. After the application, unfixed dyes are removed by a soaping method based on the ISO 105-C06 textiles test for color fastness. A control cotton sample can also be prepared for the comparison of the performance of nanocellulose-dye with conventional exhaustion methods. Dye fixation may be measured as an amount of dye molecules that are fixed on the textile material, which is the ratio of maximum color strength associated with the dye molecule employed before and after soaping process. Dye fixation may be measured via:

$$F = \frac{C_s}{C_o}, \quad \text{(eq. 2)}$$

where F represents dye fixation, $C_o$ represents initial color strength, and $C_s$ represents color strength after washing.

Figure 6A:
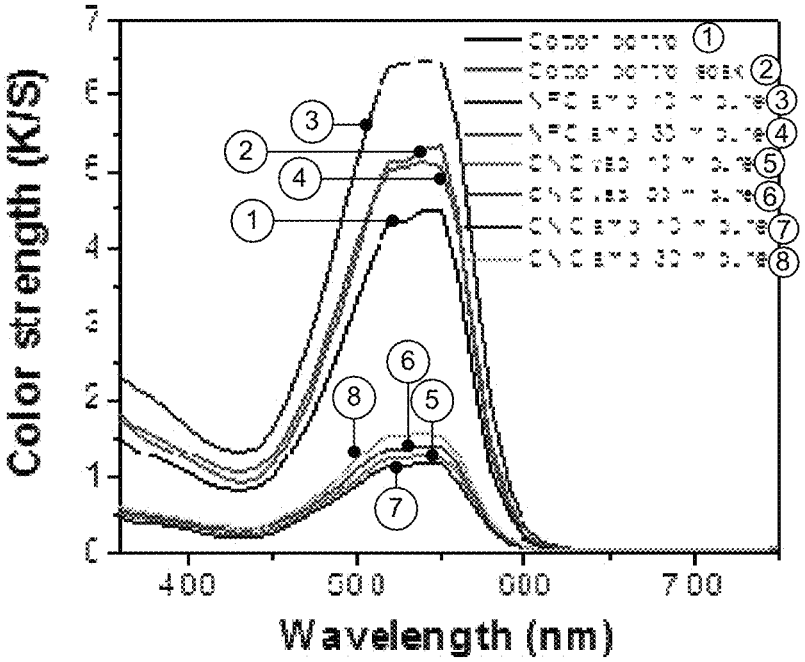
FIG. 6A shows a color strength spectra of dyed cotton fabric by conventional exhaustion dyeing, NFC nanocellulose-dye (ND), and CNC-ND before soaping.
Figure 6B:
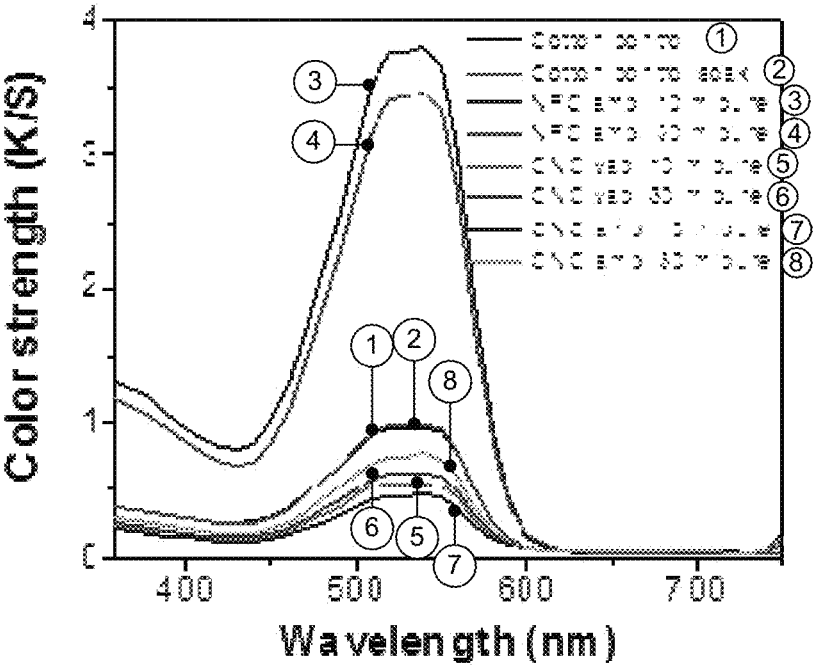
FIG. 6B shows a color strength spectra of dyed cotton fabric by conventional exhaustion dyeing, and NFC-ND, and CNC-ND after soaping.

FIGS. 6A-6B show the color strengths of dyed cotton by exhaustion method, NFC-cotton, and CNC-cotton with various processing variables. The retention of the overall shape of spectrum suggests there is no structural change in the dye molecule on the cotton fabric during soaping. Compared to the cotton control dyed by the exhaustion method, the color strength of NFC-cotton is much higher both before and after soaping. Consequently, dye fixation of NFC-cotton is around three times greater than the cotton control, as summarized in Table 1, reproduced below:

TABLE 1

Dye Fixation for Control Cotton, NFC-Cotton, and CNC-Cotton with Various Processing Variables

| | Cotton Control | Cotton Control with Soaping | NFC-Cotton 10 min Cure | NFC-Cotton 30 min Cure | CNC-Cotton (vac. dry) 10 min Cure | CNC-Cotton (vac. dry) 30 min Cure | CNC-Cotton (amb. dry) 10 min Cure | CNC-Cotton (amb. dry) 30 min Cure |
|---|---|---|---|---|---|---|---|---|
| Dye Fixation (at 510 nm) | 23% | 20% | 60% | 68% | 46% | 47% | 41% | 51% |

Although the color strength of CNC-cotton before soaping is lower than for the cotton control, more dye molecules are retained in CNC-cotton, which leads to two-fold larger dye fixation for CNC-cotton than cotton control. Processing variables, such as the concentration of dyeing auxiliaries and reaction times, can be optimized to increase dye fixation of Reactive Red 120 or other dyes. A 70-80% dye fixation can be expected for reactive dye systems. After optimization of the processing variables, the dye fixations of cotton control, dyed NFC, and CNC gels reach 75%, 66%, and 32%, respectively, as summarized in Table 2, reproduced below:

TABLE 2

Color Strength (K/S) and Dye Fixation of Dyed Cotton Fabrics by Exhaustion Dyeing (No Coating), Coating with NFC, and CNC on Neat Cotton

| | Exhaustion dyeing (no coating) | Dyed NFC | Dyed CNC | Dyed NFC with PEI | Dyed CNC with PEI | Dyed NFC-PGMA | Dyed NFC-PGMA on Polyester |
|---|---|---|---|---|---|---|---|
| K/S before Soap | 21.6 | 6.8 | 4.7 | 9.8 | 5.3 | 5.1 | 1.2 |
| K/S after Soap | 16.2 | 4.5 | 1.5 | 9.2 | 2.1 | 4.6 | 1.0 |
| Dye Fixation | 75% | 66% | 32% | 94% | 39% | 92% | 81% |

To further increase dye fixation of nanocellulose-dye on cotton, various approaches can be made, such as the use of cationic polyelectrolyte and the use of a polymeric anchoring layer that would provide additional adhesion between fabric and the nanocellulose-dye. In various embodiments, an epoxy group can be employed to provide crosslinking between nanocellulose-dye and the fabric to yield strong adhesion.

Figure 7A:
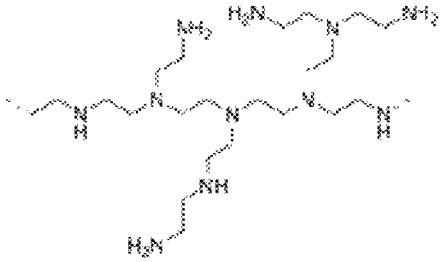
FIG. 7A shows the chemical structure of polyethylenimine (PEI).

Since nanocellulose and cotton fibers are anionic in nature, adhesion between two materials can be compromised by repulsive forces arising from electrostatic interaction. Such repulsive forces can be mitigated by employing polyelectrolytes containing cationic charges. FIG. 7A shows the chemical structure of polyethyleneimine (PEI) containing cationic polyelectrolytes. In an example PEI treatment, fabric to be dyed or coated (e.g., cotton fabric) may be pretreated by submerging the fabric into a PEI solution of 2.5 mg/mL for 10 minutes and then rinsed with deionized water by dipping two times for three minutes each. After the PEI treatment, excess water in cotton fabric may be removed by gently pushing kimwipes on fabric.

Figure 7B:
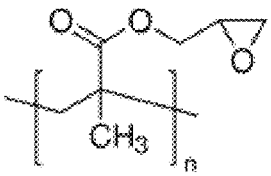
FIG. 7B shows the chemical structure of polyglycidyl methacrylate (PGMA).
Figure 7C:
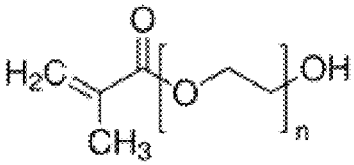
FIG. 7C shows the chemical structure of polyoligoethylene glycol methacrylate (POEGMA).
Figure 8:
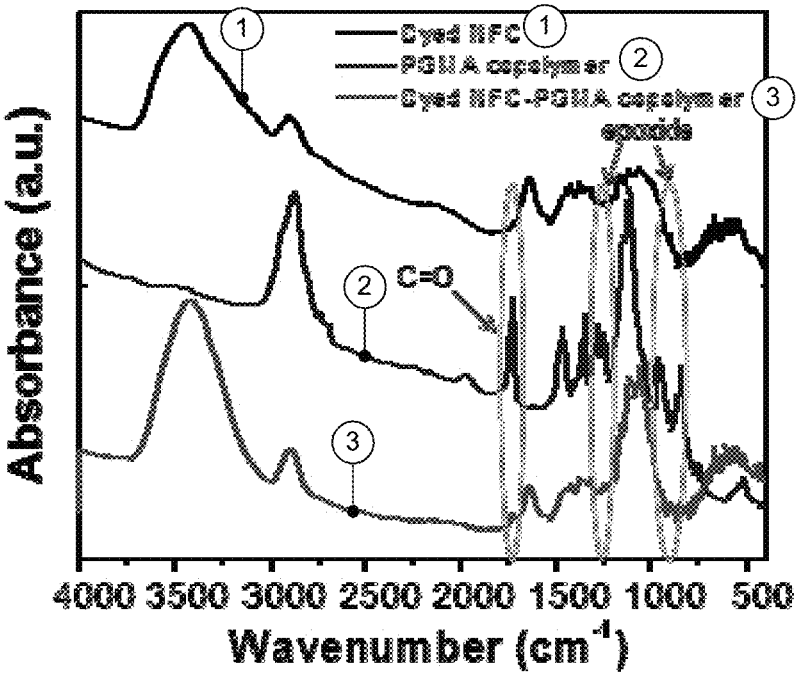
FIG. 8 shows a FT-IR spectra of ND (dyed NFC), PGMA copolymer, and ND-PGMA copolymer.

FIG. 7B shows the chemical structure of poly(glycidyl methacrylate) (PGMA) and FIG. 7C shows the chemical structure of poly(oligo(ethylene glycol) methacrylate) (POEGMA). Ethylene glycol may be employed to improve solubility of the copolymer in water. In a typical protocol, the anchoring polymer may be mixed with nanocellulose-dye gel, and stirred overnight or for a suitable period of time (e.g., eight hours). The mixture may be collected by centrifugation and the adsorption of the copolymer in nanocellulose-dye may be confirmed by Fourier transform infrared spectroscopy (FTIR) via the presence of C═O bond after mixing, as shown in FIG. 8. For example, after three hours of curing at 140° C., a cotton fabric coated with PGMA-modified nanocellulose-dye gel shows a dye fixation of 92%, as shown in Table 2. The nanocellulose-dye gel also shows 81% dye fixation on polyester fabric, which has poor adhesion to nanocellulose gel.

Figure 9:
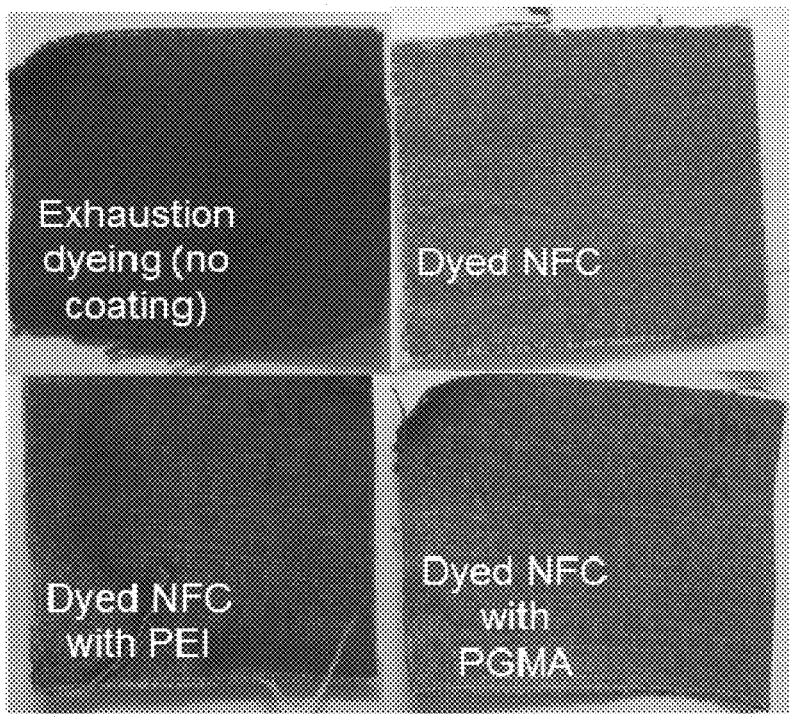
FIG. 9 shows photographs of cotton fabrics dyed by exhaustion dyeing, NFC coating, NFC coating with PEI treatment, and NFC-PGMA coating.

Subsequent dyeing may be performed by applying nanocellulose-dye on PEI-treated cotton on both sides by a squeegee, followed by curing at a suitable temperature for a predefined period of time. In various embodiments, the cotton fabric may be cured at approximately 105° C. for one hour. As summarized in Table 2, PEI treatment on cotton substantially increases color strength and dye fixation up to 94%. The enhancement may be attributed to the suppressed electrostatic repulsion between nanocellulose-dye and cotton fibers. FIG. 9 shows photographs of cotton fabrics dyed by exhaustion dyeing, NFC coating, NFC coating with PEI treatment, and NFC-PGMA coating.

In order to maximize dye exhaustion and fixation of textiles dyed with nanocellulose-dye, processing parameters can be optimized that include the application method of nanocellulose-dye and the thermal treatment protocol of nanocellulose-dye applied textile. Moreover, more adhesion between the nanocellulose-dye and the textile material may be increased by grafting nanocellulose with an epoxy group that potentially anchors on the nanocellulose surface by crosslinking reactions upon exposure to heat.

Further, higher dye exhaustion indicates a more efficient and economical dyeing process. Under the same conditions, nanocellulose-dye materials outperform neat cotton treated by a conventional exhaustion method (54% for dyed NFC over 27% for dyed cotton). The larger surface area of nanocellulose materials leads to better adsorption of dye molecules on nanocellulose. Further optimization may be employed by controlling variables in dyeing processes such as reaction time, the amount, and the feed timing of dye auxiliaries.

Figure 10:
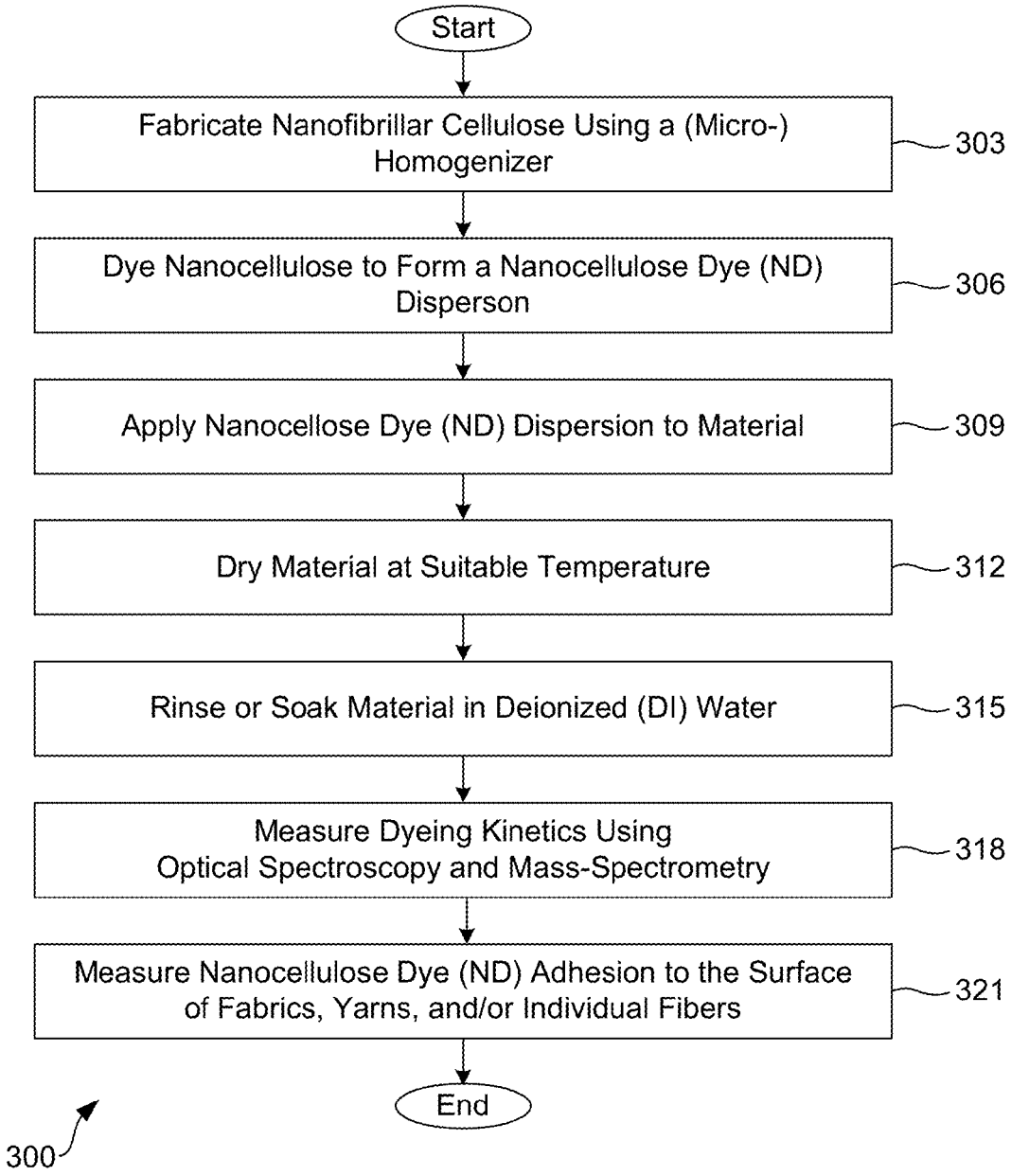
FIG. 10 is a flowchart illustrating one example of a fabric dyeing process using nanocellulose according to various embodiments of the present disclosure.

FIG. 10 shows a flowchart 300 that provides one example of a dyeing process described herein according to various embodiments. It is understood that the flowchart of FIG. 10 provides merely an example of the many different types dyeing processes that may be employed as described herein.

Starting with 303, a nanofibrillar cellulose may be fabricated using, for example, a homogenizer or a micro-homogenizer. In various embodiments, nanocellulose prepared from wood pulp fibers (or other suitable fibers) may be knife milled and homogenized using the homogenizer or micro-homogenizers. In some embodiments, a GAULIN® homogenizer may be employed to create a nanocellulose gel with a 1% to 6% weight consistency.

Next, in 306, nanocellulose may be dyed to form a nanocellulose-dye. In other words, a certain quantity of nanocellulose solution or gel may be mixed with a dye stock having a predefined dye concentration. In various embodiments, the dye applied to the nanocellulose in 306 may comprise a commercial dye stock. For example, the dye stock may include a cold Reactive Red 120 dye stock solution having a certain dye concentration.

The samples can then be dried at, for example, 100° C. for 90 seconds, followed by conditioning for a predefined period of time (e.g., approximately two hours) and a rubbing fastness crocking test.

In 309, the nanocellulose-dye may be applied to a material. In various embodiments, the material may comprise a textile material that includes, for example, polyester fibers, acrylic fibers, polypropylene fibers, cotton fibers, nylon fibers, a combination thereof, or other suitable fibers. The nanocellulose-dye may be applied to a material by pad dyeing, rotary screen printing, package dyeing, or other suitable dyeing technique.

With respect to pad dyeing, nanocellulose-dye is dispersed in water and applied to the fabric using a padder. The fabric is first saturated in the pad bath. Then, the excess of liquor is removed from the material (e.g., squeezed off) and/or dried. Second, nanocellulose may be applied to a material, such as a textile material, using rotary screen printing. In rotary screen printing, a perforated cylindrical screen may be employed to apply nanocellulose-dye dispersed in water onto the material. Then, the nanocellulose-dye liquor may be forced from the interior of the perforated cylindrical screen onto the material.

Package dyeing may be conducted through forced circulation of nanocellulose-dye liquor through packages of cotton yarn and fabric. According to various embodiments, the nanocellulose-dye based liquor may be reused. For example, after the package dyeing process is complete, the concentration of the dye left in the liquor may be replenished by adding nanocellulose-dye concentrated dispersions for a future use.

For both the pad and printing processes described above, the optimal concentration for nanocellulose-dye in the liquor and the necessary temperature profile for a drying oven to reach uniform and permanent dyeing may be predetermined. For example, rheometrical measurements may be employed to identify the viscosity of the nanocellulose-dye liquors that offer the best results. The viscosity values may be used to provide guidance for the subsequent dyeing.

Next, in 312, the material with the applied nanocellulose-dye can be dried at a predefined temperature. In some embodiments, the predefined temperature ranges from 20° C. to 150° C., although other ranges are intended to be within the scope of the present disclosure. In 315, the material can then be rinsed or soaked in water. In some embodiments, the water includes deionized water. Further, in some embodiments, the samples can be rinsed or soaked in the DI water for an approximate period of twelve hours or other suitable length of time.

In 318, the dyeing kinetics may be measured and/or studied using optical spectroscopy and mass spectrometry. Further, in 321, the nanocellulose-dye adhesion to the surface of fabrics, yarns, and/or individual fibers may be measured using, for example, spectroscopy, microscopy, and differential scanning calorimetry methods.

Although the flowchart of FIG. 10 shows a specific order of execution, it is understood that the order of performance may differ from that which is depicted. For example, the order of execution of two or more blocks may be scrambled relative to the order shown. Also, two or more blocks shown in succession in FIG. 10 may be performed concurrently or with partial concurrence. Further, in some embodiments, one or more of the blocks shown in FIG. 10 may be skipped or omitted. It is understood that all such variations are within the scope of the present disclosure.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%; and dyeing a textile material using the dyed nanocellulose dispersion, wherein dyeing the textile material using the dyed nanocellulose dispersion comprises pad dyeing, rotary screen printing, or package dyeing the textile material.

2. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%; and pad dyeing a textile material using the dyed nanocellulose dispersion, wherein pad dyeing the textile material comprises:

dispersing the dyed nanocellulose dispersion in a liquid;

applying the dyed nanocellulose dispersion to the textile material using a padder;

saturating the textile material in a pad bath; and removing excess liquid from the textile material.

3. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%; and rotary screen printing a textile material using the dyed nanocellulose dispersion, wherein rotary screen printing the textile material comprises:

applying the dyed nanocellulose dispersion via a perforated cylindrical screen dispersed in water onto the textile material; and forcing the dyed nanocellulose dispersion from an interior of the perforated cylindrical screen onto the textile material.

4. The method of claim 1, further comprising drying the textile material at a temperature between 20° C. and 120° C.

5. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%; and dyeing a textile material using the dyed nanocellulose dispersion, wherein the dyeing of the textile material is performed during a generation of the dyed nanocellulose dispersion.

6. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%; and dyeing a textile material using the dyed nanocellulose dispersion, wherein the dyeing of the textile material is performed after a generation of the dyed nanocellulose solution dispersion.

7. The method of claim 3, wherein the textile material further comprises a plurality of polyester fibers, a plurality of acrylic fibers, a plurality of polypropylene fibers, a plurality of cotton fibers, a plurality of nylon fibers, or a combination thereof.

8. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%;

mixing a polyglycidyl methacrylate (PGMA) polymer with the dyed nanocellulose dispersion prior to dyeing a textile material using the dyed nanocellulose dispersion; and dyeing the textile material using the dyed nanocellulose dispersion.

9. A method, comprising:

preparing, from at least a plurality of wood pulp fibers, a dyed nanocellulose dispersion comprising a plurality of nanosized cellulose fibrils using a homogenizer, wherein the dyed nanocellulose dispersion comprises a concentration of between 0.5% and 6%;

pretreating a textile material with a polyethyleneimine (PEI) solution prior to dyeing the textile material using the dyed nanocellulose dispersion; and dyeing the textile material using the dyed nanocellulose dispersion.

10. A textile material, wherein the textile material is dyed by:

applying a dyed nanocellulose dispersion to the textile material, the dyed nanocellulose dispersion comprising a plurality of nanosized cellulose fibrils;

drying the textile material at a predefined temperature; and rinsing the textile material using a rinsing solution.

11. The textile material of claim 10, wherein the dyed nanocellulose dispersion is mixed with a polyglycidyl methacrylate (PGMA) polymer prior to the applying of the dyed nanocellulose dispersion to the textile material.

12. The textile material of claim 10, wherein the textile material is pretreated with a polyethyleneimine (PEI) solution prior to the applying of the dyed nanocellulose dispersion to the textile material.

13. The textile material of claim 10, wherein applying the dyed nanocellulose dispersion to the textile material further comprises pad dyeing, rotary screen printing, or package dyeing the textile material.

14. The textile material of claim 13, wherein pad dyeing the textile material further comprises:

dispersing the dyed nanocellulose dispersion in a liquid;

applying the dyed nanocellulose dispersion to the textile material using a padder; and removing excess liquid from the textile material.

15. The textile material of claim 13, wherein rotary screen printing the textile material further comprises:

applying the dyed nanocellulose dispersion through a perforated cylindrical screen dispersed in a solution onto the textile material; and forcing the dyed nanocellulose dispersion from an interior of the perforated cylindrical screen onto the textile material.

16. The textile material of claim 10, wherein the predefined temperature is a temperature between 20° C. and 150° C.

17. The textile material of claim 10, wherein the dyed nanocellulose dispersion is produced from a plurality of wood pulp fibers.

18. The textile material of claim 10, wherein the textile material further comprises a plurality of polyester fibers, a plurality of acrylic fibers, a plurality of polypropylene fibers, a plurality of cotton fibers, a plurality of nylon fibers, or a combination thereof.

19. The method of claim 1, wherein the textile material further comprises a plurality of polyester fibers, a plurality of acrylic fibers, a plurality of polypropylene fibers, a plurality of cotton fibers, a plurality of nylon fibers, or a combination thereof.

20. The method of claim 2, wherein the dyed nanocellulose dispersion is mixed with a polyglycidyl methacrylate (PGMA) polymer prior to the applying of the dyed nanocellulose dispersion to the textile material.

21. The method of claim 2, further comprising pretreating the textile material with a polyethyleneimine (PEI) solution prior to the applying of the dyed nanocellulose dispersion to the textile material.

22. The method of claim 3, further comprising drying the textile material at a temperature between 20° C. and 120° C.

23. The method of claim 5, further comprising drying the textile material at a temperature between 20° C. and 120° C.

24. The method of claim 6, further comprising drying the textile material at a temperature between 20° C. and 120° C.

25. The method of claim 8, further comprising drying the textile material at a temperature between 20° C. and 120° C.

26. The method of claim 9, wherein the textile material further comprises a plurality of polyester fibers, a plurality of acrylic fibers, a plurality of polypropylene fibers, a plurality of cotton fibers, a plurality of nylon fibers, or a combination thereof.

* * * * *